US006427250B1

(12) United States Patent
Stull et al.

(10) Patent No.: US 6,427,250 B1
(45) Date of Patent: Aug. 6, 2002

(54) PROTECTIVE GLOVE

(75) Inventors: Jeffrey O. Stull, Austin, TX (US); William L. Grilliot; Mary I. Grilliot, both of Dayton, OH (US); Jerry R. Novak, Edina, MO (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 09/678,054

(22) Filed: Oct. 3, 2000

(51) Int. Cl.[7] ..... A41D 19/00
(52) U.S. Cl. ..... 2/161.6; 2/16; 2/163; 2/167
(58) Field of Search ..... 2/16.2, 161.1, 2/161.5, 161.6, 161.7, 161.8, 163, 167, 169

(56) References Cited

U.S. PATENT DOCUMENTS 4,433,439 A * 2/1984 Sidman et al ..... 2/161
4,454,611 A * 6/1984 Tschirch et al. ..... 2/161
4,918,756 A 4/1990 Grilliot et al.
5,231,700 A * 8/1993 Cutshall ..... 2/161.7
5,685,015 A * 11/1997 Aldridge ..... 2/81
5,822,796 A * 10/1998 Harges, Jr. et al. ..... 2/161.6
6,155,084 A * 12/2000 Andrews et al. ..... 66/174

* cited by examiner

*Primary Examiner*—John J. Calvert
*Assistant Examiner*—Katherine Moran
(74) *Attorney, Agent, or Firm*—Wood, Phillips, Katz, Clark & Mortimer

(57) ABSTRACT

A protective glove, such as a firefighter's glove has a back, a front defining a palm, a thumb, and four fingers. An outer shell of the protective glove comprises an expanse of a radiant reflective material, such as an aluminized fabric, and an expanse of a material defining a gripping surface, such as a sueded leather. The expanses are configured and are sewn together so that the radiant reflective material covers the back of the glove and covers the back, side, and end surfaces of the thumb and four fingers of the glove and so that the material defining the gripping surface covers the palm and the front surfaces of the thumb and four fingers. A separate piece of the radiant reflective material is sewn to the expanses so as to overlap a tip portion of the material defining the gripping surface, on the front of the thumb, at the tip of the thumb. A separate piece of the radiant reflective material is sewn to the expanses so as to overlap cover a tip portion of the material defining the gripping surface, on the front of each finger, at the tip of said finger.

4 Claims, 2 Drawing Sheets

PROTECTIVE GLOVE

TECHNICAL FIELD OF THE INVENTION

This invention pertains to a protective glove, such as a firefighter's glove, of a type comprising an outer shell made from a radiant reflective material, such as an aluminized fabric, and from a material providing a gripping surface, such as a sueded leather.

BACKGROUND OF THE INVENTION

National Fire Protection Association 1976 Standard 4-3.6.2 is directed to a protective glove of the type noted above and provides as follows:

4-3.6.2 The radiant reflective material shall provide coverage for the finger/thumb tip of at least 195 degrees, +10°/−0° as specified in Figure 4-3.6.1. The portion of the finger, thumb, and palm surfaces that are not covered by the radiant reflective protection shall be the is gripping surface of the glove.

As referenced in National Fire Protection Association 1976 Standard 4-3.6.2, supra, Figure 4-3.6.1 is reproduced as FIG. 4 of the appended drawings.

In a conventional construction, a protective glove of the type noted above has an outer shell, which is made from an aluminized fabric serving as a radiant reflective material and from a sueded leather defining the gripping surface. In the conventional construction, the aluminized fabric and the sueded leather are sewn together at a seam running along the sides of the palm, thumb, and four fingers of the protective glove. In the conventional construction, the aluminized fabric and the sueded leather do not overlap, except along the seam.

As it has been found to be very difficult to make a protective glove utilizing the conventional construction and conforming to National Fire Protection Association 1976 Standard 4-3.6.2, supra, a need has been ascertained for a better construction for a protective glove, which can conform to National Fire Protection Association 1976 Standard 4-3.6.2, supra.

SUMMARY OF THE INVENTION

This invention provides a protective glove, such as a firefighter's glove, of a novel construction, which is intended to be less difficult to make and which can conform to National Fire Protection Association 1976 Standard 4-3.6.2, supra. Although a firefighter's glove is contemplated, the protective glove provided by this invention may prove to be also suitable for others, possibly for a welder or for a person tending a fireplace, furnace, or stove burning a fossil fuel.

The protective glove has a back, a front defining a palm, a thumb, and four fingers. The thumb has a tip and front, back, side, and end surfaces. Each finger has a tip and front, back, side, and end surfaces. The protective glove comprises an outer shell, in which the novel construction is embodied.

In a preferred embodiment, the protective glove comprises a thermal liner and a moisture barrier, which are outside the scope of this invention. In the preferred embodiment, the protective glove comprises a wristlet, which is outside the scope of this invention.

The outer shell comprises an expanse of a radiant reflective material, such as an aluminized fabric, and an expanse of a material defining a gripping surface, such as a sueded leather. The expanses are configured and are sewn together, as along a seam running along the sides of the palm, thumb, and four fingers of the protective glove, so that the radiant reflective material covers the back of the glove and covers the back, side, and end surfaces of the thumb and four fingers of the glove and so that the material defining the gripping surface covers the palm and the front surfaces of the thumb and four fingers.

According to the novel construction, five mote separate pieces of the radiant reflective material are employed. Thus, a separate piece of the radiant reflective material is sewn to the expanse of the radiant reflective material and to the expanse of the material defining the gripping surface so as to overlap only a tip portion of the material defining the gripping surface, on the front of the thumb and so as to allow the remaining portion of the material defining the gripping surface, on the front of the thumb, to remain exposed. Also, a separate piece of the radiant reflective material is sewn to the expanse of the radiant reflective material and to the expanse of the material defining the gripping surface so as to overlap only a tip portion of the material defining the gripping surface, on the front of each finger, and so as to allow the remaining portion of the material defining the gripping surface, on the front of said finger, to remain exposed.

DETAILED DESCRIPTION OF THE PREFERRED EMBODIMENT

Figure 1:
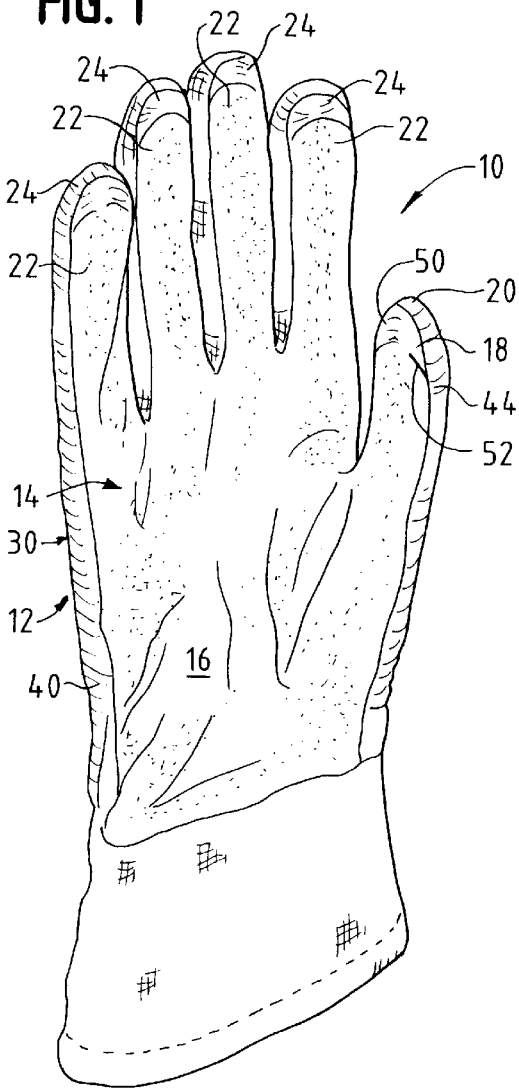
FIG. 1 is a perspective view of a protective glove constituting a preferred embodiment of this invention.
Figure 2:
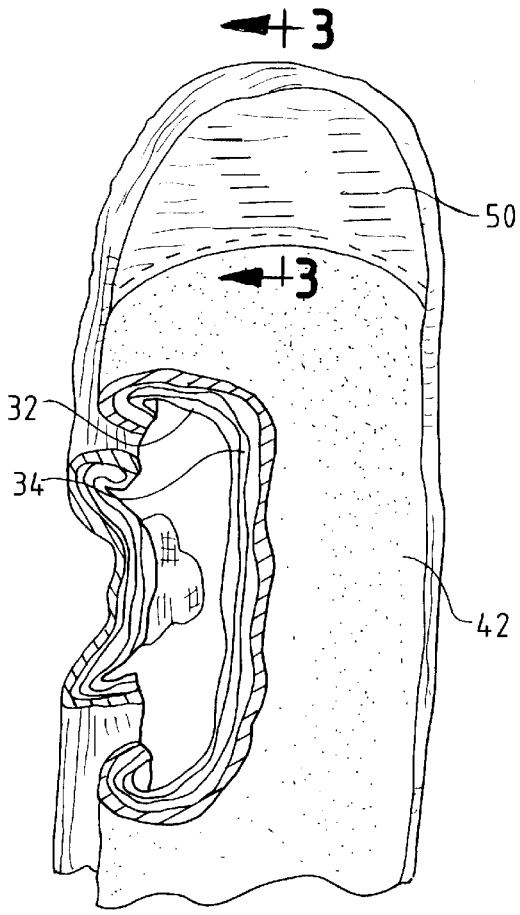
FIG. 2, on a larger scale, is a fragmentary detail of a representative finger of the protective glove.
Figure 3:
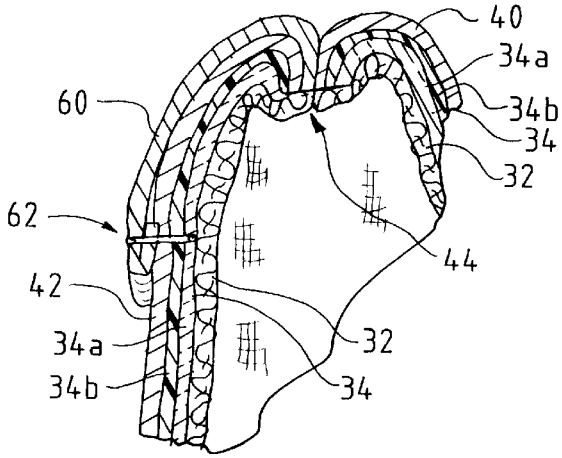
FIG. 3 is a fragmentary section, as taken along line 3—3 of FIG. 2, in a direction indicated by arrows.
Figure 4:
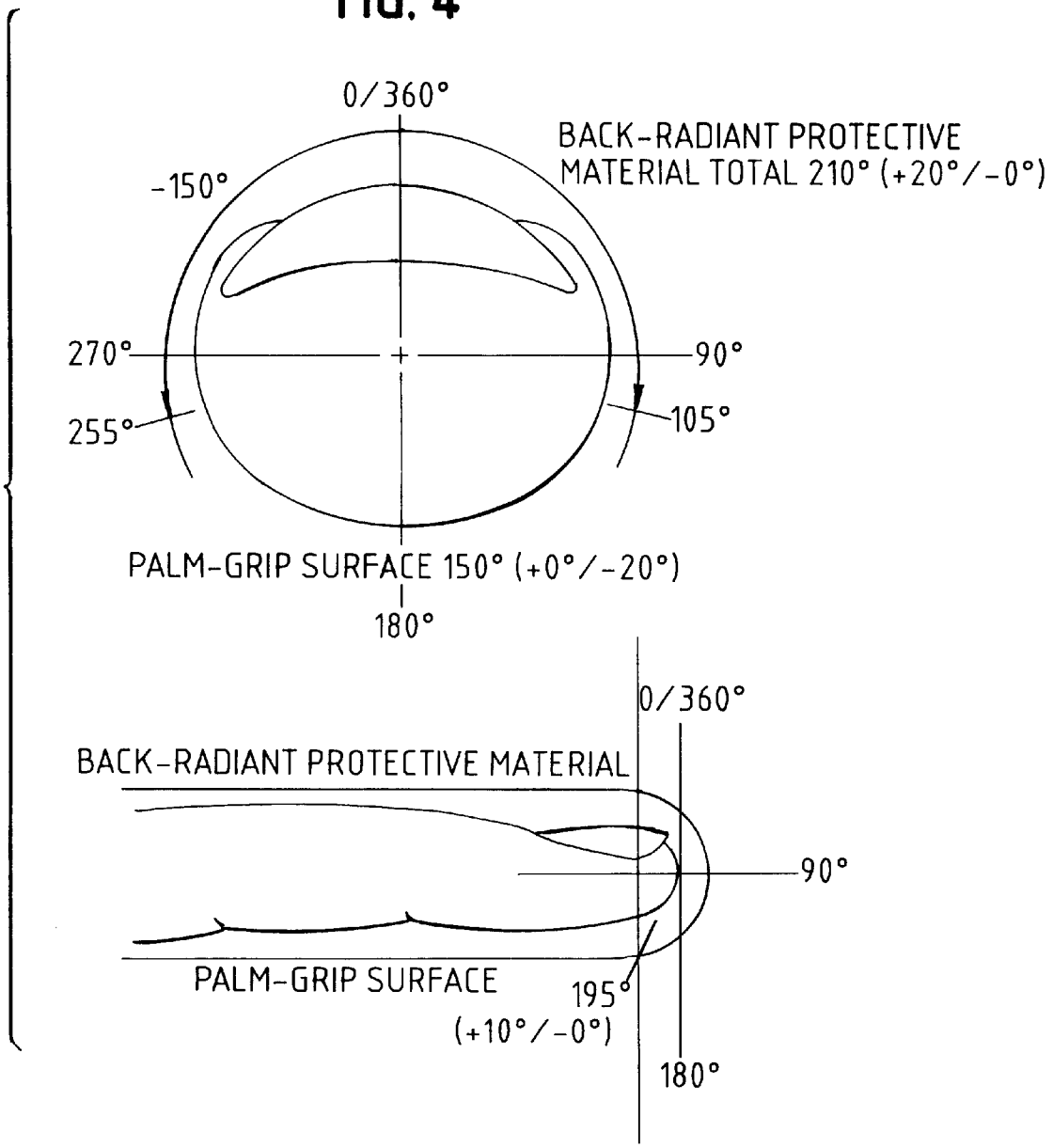
FIG. 4 is a reproduction of Figure 4-3.6.1, which is referenced in National Fire Protection Association 1976 Standard 4-3.6.2, supra.

As shown in FIG. 1, a protective glove 10, such as a firefighter's glove, constitutes a preferred embodiment of this invention. The protective glove 10 has a back 12, a front 14 defining a palm 16, a thumb 18 having a tip 20, and four fingers 22, each having a tip 24. The protective glove 10 has an outer shell 30, in which the novel construction provided by this invention is embodied.

The protective glove 10 has an inner liner 32, which is a thermal liner, and an intermediate liner 34, which is a moisture barrier having a fabric layer 34*a* and a hydrophobic layer 34*b*. Such liners are conventional in a protective glove, such as a firefighter's glove, and the liners 32, 34, are outside the scope of this invention. The protective glove has a wristlet 36. Such a wristlet is conventional in a protective glove, such as a firefighter's glove, and the wristlet 36 is outside the scope of this invention.

The outer shell 30 comprises an expanse 40 of an aluminized fabric, such as an aluminized knit comprising approximately 33% polybenzimidazole fibers and approximately 67% polyparaphenylene terephthalamide fibers, and an expanse 42 of a sueded leather, such as sueded cowhide. The aluminized fabric is a radiant reflective material and the sueded leather defines a gripping surface. Each of the expanses 40, 42, may be made in plural pieces, which are sewn together, or in one piece. As shown, the expanse 40 of the aluminized fabric comprises a back piece and a separate piece, which is sewn to the back piece and which extends along the side end and end surfaces of the thumb 18 and four fingers 22.

The expanses 40, 42, are configured and are sewn together, along an edge seam 44 running along the sides of the palm 16, thumb 18, and four fingers 22, so that the expanse 40 of the aluminized fabric covers the back 12 and covers the back, side, and end surfaces of the thumb 18 and four fingers 22 and so that the expanse 42 of the sueded leather covers the palm 16 and the front surfaces of the thumb 18 and four fingers 22.

According to the novel construction, a separate piece 50 of the aluminized fabric material is sewn to the expanses 40, 42, along the edge seam 44 and along a flat seam 52 between the separate piece 50 and the expanse 42 of the sueded leather, so as to overlap a tip portion of the expanse 42 of the sueded leather, on the front of the thumb 18, at its tip 20.

According to the novel construction, a separate piece 60 of the aluminized fabric is sewn to the expanses 42, 44, along the edge seam 44 and along a flat seam 62 between the separate piece 60 and the expanse 42 of the sueded leather, so as to overlap a tip portion of the material defining the gripping surface, on the front of each finger, at its tip 24.

Because the separate pieces 50, 60, cover only the tip portions of the material defining the gripping surface, on the front of the thumb 18 and on the front of each finger 22, the remaining portions of the material defining the gripping surface, on the front of the thumb 18 and on the front of each finger 22, are allowed by the separate pieces 50, 60, to remain and, as shown, remain exposed.

Preferably, the expanses 42, 44, and the separate pieces 50, 60, are configured so that the protective glove 10 conforms to National Fire Protection Association 1976 Standard 4-3.6.2, supra.

What is claimed is:

1. A protective glove having a back, a front defining a palm, a thumb, and four fingers, the thumb having a tip and front, back, side, and end surfaces and each finger having a tip and front, back, side, and end surfaces, the glove comprising an outer shell, which comprises an expanse of a radiant reflective material and an expanse of a material defining a gripping surface, the expanses configured and sewn together so that the radiant reflective material covers the back of the glove and covers the back, side, and end surfaces of the thumb and four fingers of the glove and so that the material defining the gripping surface covers the palm and the front surfaces of the thumb and four fingers, and five more separate pieces of the radiant reflective material, which separate pieces comprise a separate piece of the radiant reflective material being sewn to the expanse of the radiant reflective material and to the expanse of the material defining the gripping surface so as to overlap only a tip portion of the material defining the gripping surface, on the front of the thumb, at the tip of the thumb, and so as to allow the remaining portion of the material defining the gripping surface, on the front of the thumb, to remain exposed, and a separate piece of the radiant reflective material being sewn to the expanse of the radiant reflective material and to the expanse of the material defining the gripping surface so as to overlap only a tip portion of the material defining the gripping surface, on the front of each finger, at the tip of said finger, and so as to allow the remaining portion of the material defining the gripping surface, on the front of the thumb, to remain exposed.

2. The protective glove of claim 1 wherein the radiant reflective material comprises an aluminized fabric.

3. The protective glove of claim 1 wherein the material defining the gripping surface comprises a sueded leather.

4. The protective glove of claim 1 wherein the radiant reflective material comprises an aluminized fabric and wherein the material defining the gripping surface comprises a sueded leather.

* * * * *